US006780085B2

(12) United States Patent
Wolf

(10) Patent No.: US 6,780,085 B2
(45) Date of Patent: Aug. 24, 2004

(54) FIBER OPTICAL SENSOR EMBEDDED INTO THE POLISHING PAD FOR IN-SITU, REAL-TIME, MONITORING OF THIN FILMS DURING THE CHEMICAL MECHANICAL PLANARIZATION PROCESS

(76) Inventor: Stephan H. Wolf, 1649 17th St., Los Osos, CA (US) 93402

( * ) Notice: Subject to any disclaimer, the term of this patent is extended or adjusted under 35 U.S.C. 154(b) by 5 days.

(21) Appl. No.: 09/991,122

(22) Filed: Nov. 23, 2001

(65) Prior Publication Data

US 2003/0100243 A1 May 29, 2003

(51) Int. Cl.[7] ..... B24B 49/12
(52) U.S. Cl. ..... 451/6; 451/288
(58) Field of Search ..... 451/6, 5, 288, 451/287, 41

(56) References Cited

U.S. PATENT DOCUMENTS 5,838,447 A 11/1998 Hiyama et al.
5,913,713 A 6/1999 Cheek et al.
5,949,927 A 9/1999 Tang
6,012,967 A 1/2000 Satake et al.
6,106,662 A * 8/2000 Bibby, Jr. et al. ..... 156/345
6,146,242 A * 11/2000 Treur et al. ..... 451/6
6,190,234 B1 2/2001 Swedek et al.
6,261,151 B1 7/2001 Sandhu et al.
6,395,130 B1 * 5/2002 Adams et al. ..... 156/345.13
6,485,354 B1 * 11/2002 Wolf ..... 451/6

* cited by examiner

*Primary Examiner*—Robert A. Rose

(57) ABSTRACT

An apparatus is disclosed which improves the optical monitoring of semi-conductor wafers undergoing chemical mechanical planarization. The apparatus consists of two assemblies. Firstly, a fiber optical wave-guide assembly installed within the polishing pad during the pad's construction. This assembly forms an integrated optical waveguide originating from the center of rotation of the polishing pad and terminating at a location within the wafer track. Secondly, a vacuum hub, tube, and angular encoder assembly, which provides light coupling to the center of rotation of the polishing pad and also provides resolution of the angular position and speed of the polishing pad, polishing table, and optical waveguide.

13 Claims, 6 Drawing Sheets

FIBER OPTICAL SENSOR EMBEDDED INTO THE POLISHING PAD FOR IN-SITU, REAL-TIME, MONITORING OF THIN FILMS DURING THE CHEMICAL MECHANICAL PLANARIZATION PROCESS

BACKGROUND OF THE INVENTION

Chemical-mechanical planarization (hereafter CMP) is a process employed in the fabrication of semiconductors. Silicon wafer substrates containing hundreds of semiconductor devices are brought into contact with a rotating planarization table covered by a polishing pad. Chemicals are added to accelerate and enhance the planarization of the wafer.

The CMP process can be separated into two major categories:

The material transition process involving the complete removal of a material, such as tungsten or copper, from the surface of the wafer until the underlying material layer is exposed.

The film thinning process involving the removal of material, such as SIO2 or silicon, until a predetermined thickness remains.

Optical endpointing is one method of monitoring the reflectivity of the wafer surface during planarization and controlling the CMP process based on changes in said reflectivity. Both CMP categories can be successfully monitored with the use of monochromatic light. However, monochromatic light does not allow instantaneous film thickness measurement for the film thinning process. Endpoint systems using monochromatic light can only infer the amount of film removed during the process by monitoring the process over time, compiling several measurements, and subtracting a known beginning thickness. Endpoint systems using broadband light analyze several wavelengths of the reflectance simultaneously, and can thus measure the instantaneous film thickness directly.

In either case, the key to accurately measuring the wafer surface reflectivity is to position an optical sensor in such a way as to receive a noise-free signal. Sources of noise include thermal variations associated with the CMP process, electro-magnetic interference (EMI), light absorption, lens fogging, electrical slip-ring resistance fluctuations, and air bubbles.

In the case where the sensor is an electronic device, EMI, thermal, and slip-ring noise pose problems. Typically, polishing tables are driven by large variable-speed electric motors, which emit strong electromagnetic fields of various frequencies. Any electrical conductor transitioning these fields will be subject to induced noise.

Opto-electronic devices brought into contact with the CMP process are subject to the thermal fluctuations of the process. Polishing pad friction and exothermic chemical reactions create wide temperature changes. Optical responsivity, Johnson noise, and shot noise all increase as a function of temperature. Therefore, opto-electronic devices typically need to be temperature stabilized before their output is a true measure of the incident radiation. Also, polishing pads are manufactured using heat and pressure. In some cases manufacturing temperatures can exceed the maximum temperature rating specified in the data sheets of the device. Exceeding this rating shortens their life span, or even causes immediate malfunction.

Electrical slip rings used to couple signals from the rotating table are very sensitive to the corrosive CMP chemicals and their vapors. They wear quickly in this environment and begin to suffer from intermittent variations in their contact resistance, which results in random sensor noise. Mercury wetted slip rings are less susceptible this problem, but they are typically limited to operating temperature below 70 degrees Celsius.

Optical sensors installed into the polishing table rely upon a transparent window glued into a hole punched completely through the polishing pad. This arrangement also suffers from optical noise problems, because the pad window tends to leak and thereafter forms a layer of condensate on its under side. Light passing through the condensate layer is scattered, which results in unreliable sensor performance. This particular problem is also temperature related, and can produce indeterminate effects on the optical signal integrity.

CMP processes rely heavily upon liquid chemicals known as slurry, which are not equally translucent to all wavelengths of light. The pad window will carry a layer of slurry along as it transitions under the wafer. As the thickness of this slurry layer increases, more of the light is lost due to absorption and scattering. The thickness of the slurry layer is affected by the position of the pad window with respect to the center of the wafer. For CMP tools whose spindles oscillate and rotate during processing, the slurry layer trapped between the pad window and the wafer will vary as the spindle traverses from side to side. It is theorized that this effect is caused by the difference in relative velocity between the wafer and the polishing pad. At one extreme in the spindle's stroke the wafer is rotating in the same direction as the polishing pad, and at the other extreme the wafer is rotating in the opposite direction. As the relative velocity between wafer surface and pad increases, the slurry layer between pad window and wafer shrinks as the wafer is sucked towards the pad, and the pad window deflects upwards in response to the suction. The result is a periodic disturbance in the optical signal, whose frequency is equivalent to the spindle oscillation frequency, and whose strength is a function of slurry translucence, wafer diameter, table speed, spindle speed, and spindle oscillation stoke.

Air bubbles can produce temporary lens-like occlusions at the pad window and diffract the light in unexpected directions. Even seemingly small bubbles trapped along the fringes of the window can pose a problem when they are sandwiched between the wafer and window lens. The creation of these bubbles increases with table speed and may be due to air being sucked out from the cavity beneath leaking pad windows.

Low-pass filtering is commonly used to attenuate the noise. In most cases, frequency components of the reflectance signals are low compared to those for the noise. Sometimes high order, low cut-off frequency low pass filtering are necessary to adequately attenuate the noise. Material transition processes often exhibit rapid changes in reflectivity at the instant of break through. Using such filtering introduces a significant phase shift in the observed reflectance signal, which causes the endpoint control system to lag behind the process, and results in over-polishing of the wafer.

SUMMARY OF THE INVENTION

The present invention is an apparatus for electronic semiconductor wafer chemical-mechanical-planarization (CMP) table monitoring and includes a polishing pad and a hub. The polishing pad contains an embedded waveguide with an outer lens fixture end and a light coupling transparent center fixture end. The waveguide is arranged within the pad interior with the ends embedded within a recess on the pad polishing surface such that the ends are located on the pad polishing surface. The waveguide is arranged entirely within the pad interior such that the outer lens end is at a location within the wafer track, and the light coupling end is at the center of rotation of the polishing pad.

The hub contains a moving portion in contact with the pad, and a stationary portion rotatable connected to the moving portion in such a manner that the moving portion positions the stationary portion in relation to the pad. Light may therefore be transmitted from the hub stationary portion to the moving waveguide coupling end and light may be transmitted from the moving waveguide coupling end to the hub stationary portion. The hub stationary portion includes optical fiber to conduct light to and from the hub stationary portion to the stationary part of the CMP tool so the signal may be supplied to monitoring equipment.

An object of the present invention is to eliminate the above mentioned noise sources associated with monitoring the surface reflectivity of a wafer undergoing CMP. The invention provides an apparatus for delivering light to and receiving a corresponding reflection from the wafer surface by embedding a non-removable optical wave-guide within the polishing pad and providing a means of coupling light into and out of the wave-guide while the pad is rotating in motion.

Another object of the invention is to provide a means for determining the angular position of the polishing pad.

A third object of the invention is to provide an easily aligned and easily attached means of coupling the light into and out of the waveguide.

DETAILED DESCRIPTION OF THE INVENTION

The present invention is an apparatus for delivering light to and receiving surface reflectance from a wafer undergoing CMP. It does so by embedding a fiber-optic wave-guide within the polishing pad. The wave-guide is a combination of lenses and mirrors, which act together to guide light into the polishing pad at the waveguide light coupling transparent center fixture end, through its interior, and out of the pad at the waveguide outer lens fixture end, that is at a location within the wafer track. The wave-guide also guides light reflected by the wafer back into the polishing pad, through its interior, and out of the pad at its center of rotation.

The present invention is also an apparatus for coupling light into one end of the optical wave-guide located at the center of rotation of a polishing pad. It does so by locating a removable vacuum suction hub onto the pad, and supplying vacuum to the suction hub to anchor it firmly and in close proximity to the optical wave-guide while allowing the pad to rotate freely. Removing the vacuum allows the suction hub to be removed from the pad for the purpose of replacing the polishing pad.

The present invention is also an apparatus and technique to allow for determining the exact angular position of the wafer edges as the pad rotates. When the vacuum hub is secured to the pad, it forms the rotating member of an angular position encoder, while the vacuum tube forms the stationary member of the encoder. Electrical power for the angular position encoder is brought in via a cable installed within the vacuum tube, and the encoder's angular position signals are returned via the same cable. The angular encoder signals are used to "home the pad," in other words, locate the pad with respect to the semiconductor wafer(s). The technique involves loading the spindle with a wafer and placing it in contact with the rotating polishing pad. By simultaneously tracking the encoder counts and monitoring the reflectance signal for abrupt changes, the wafer's leading and trailing edges can be detected and the corresponding encoder counts saved to memory. The saved encoder count values can then be used to trigger optical analysis equipment at any point along the surface of the wafer as the sensor sweeps beneath it.

The present invention is also an apparatus for precisely locating the polishing pad onto the polishing table by providing locating pins on the table and corresponding locating holes in the polishing pad and waveguide.

Figure 1:
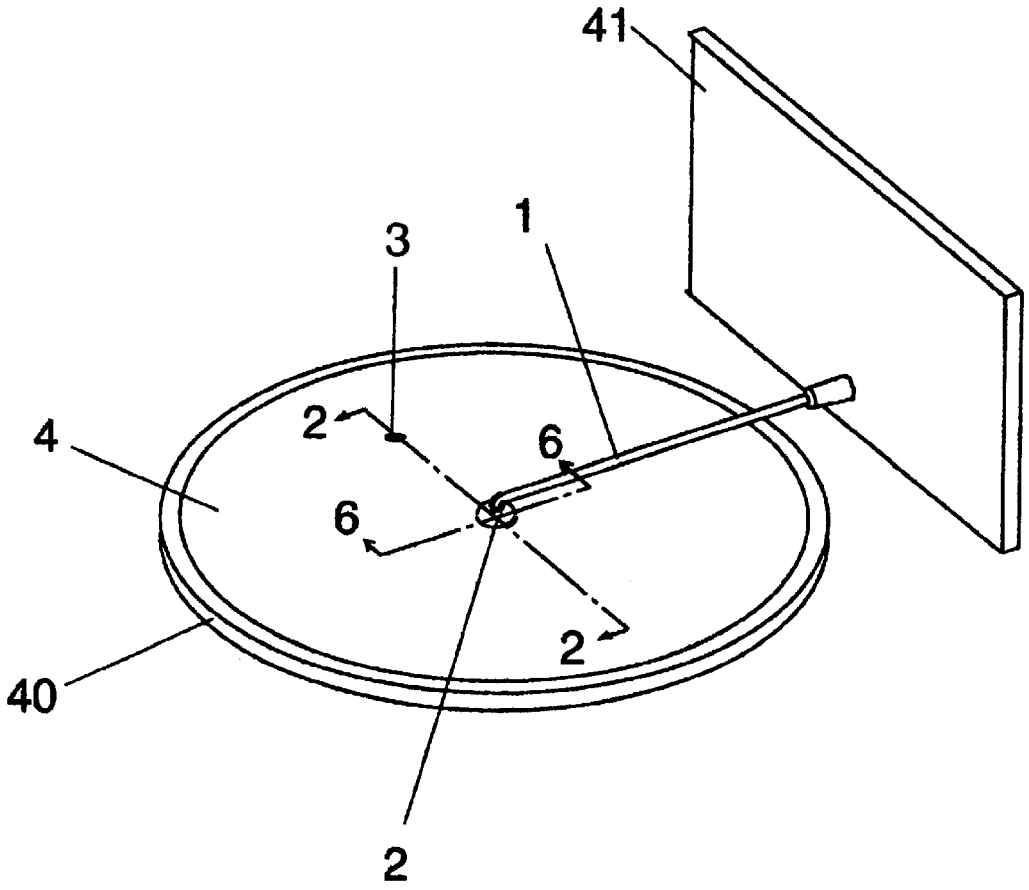
FIG. 1 is an isometric view of the present invention installed on a planarization table.

FIG. 1 shows an isometric view of the invention consisting of a vacuum tube (1) connected to the removable vacuum hub (2) located at the center of rotation of a circular polishing pad (4). An optical waveguide is installed into the pad from near the center of the wafer track (3) to the center of rotation, under the hub. The end of the vacuum tube opposite the vacuum hub will normally be attached to a stationary component of the CMP tool. FIG. 1 also shows the polishing table (40) and the connection of the vacuum tube to stationary optical analysis equipment (41).

Figure 2:
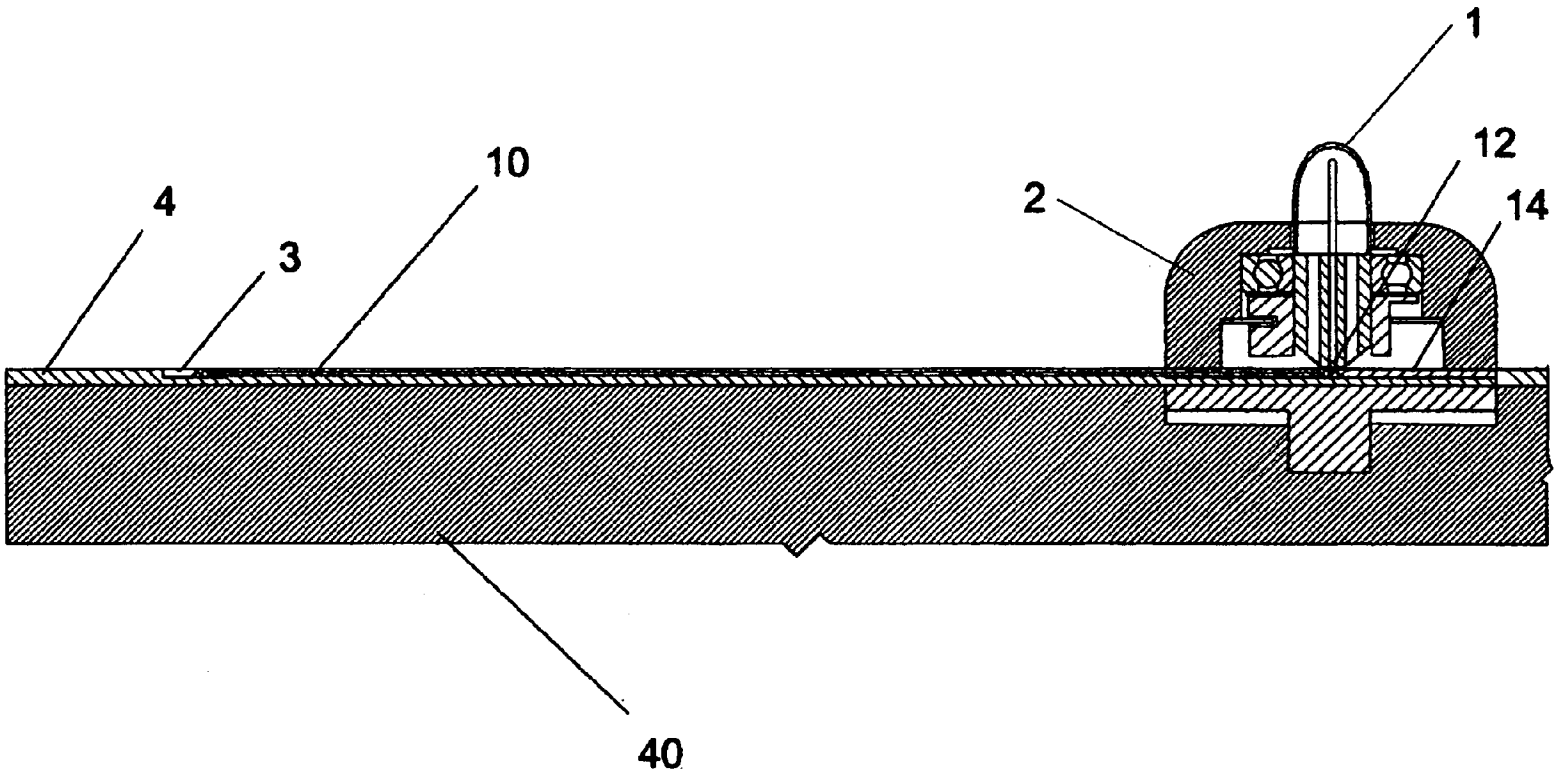
FIG. 2 is a cross-sectional view of the invention at the location shown in FIG. 1.

FIG. 2 depicts a close up isometric cross section of the invention. The vacuum tube (1) is connected to the stationary portion of the vacuum hub (2). The pad (4) contains the waveguide optical fiber (10) which has a lens (12) transparent center fixture (14) at the light coupling end transparent center located at the center of rotation, under the rotating portion of the vacuum hub, and an outer lens fixture (3) at the end located near the center of the wafer track.

Figure 3:
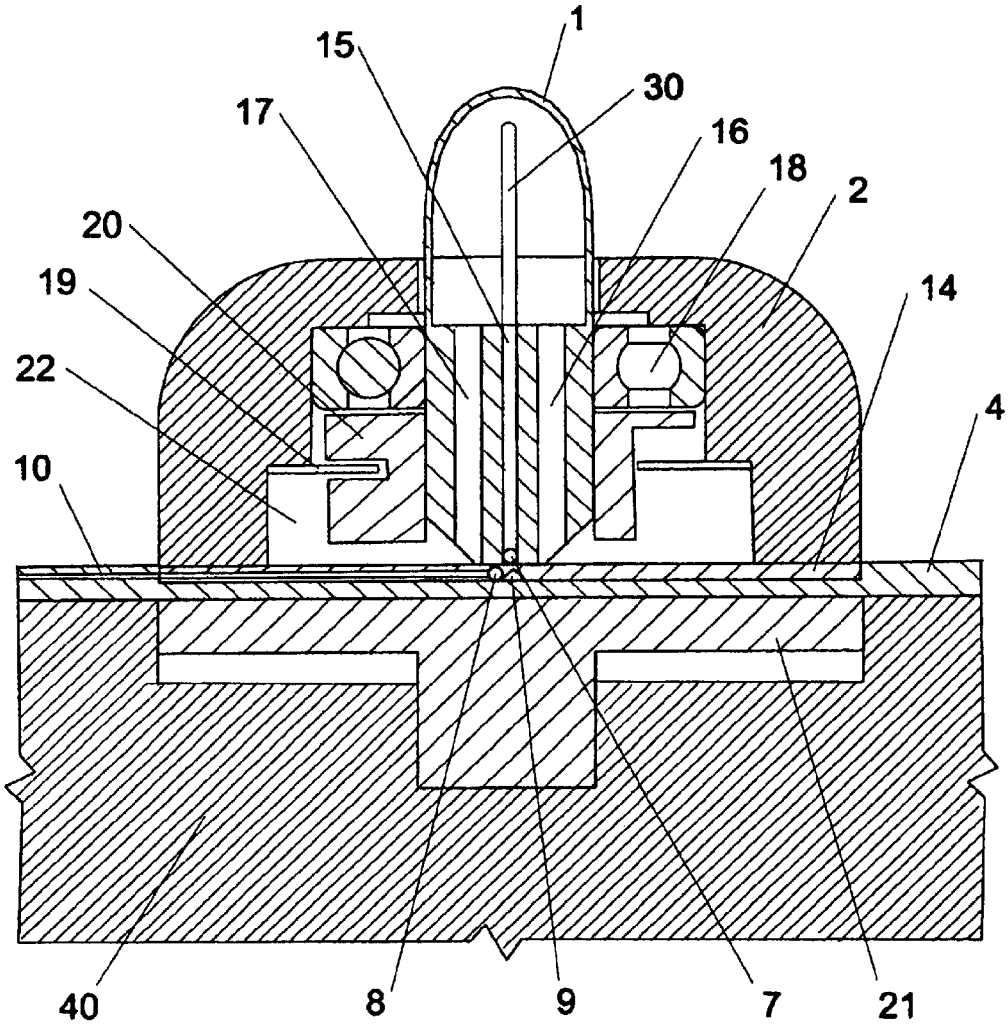
FIG. 3 is an expanded cross-sectional view of the hub at the cross-section of FIG. 2.
Figure 4:
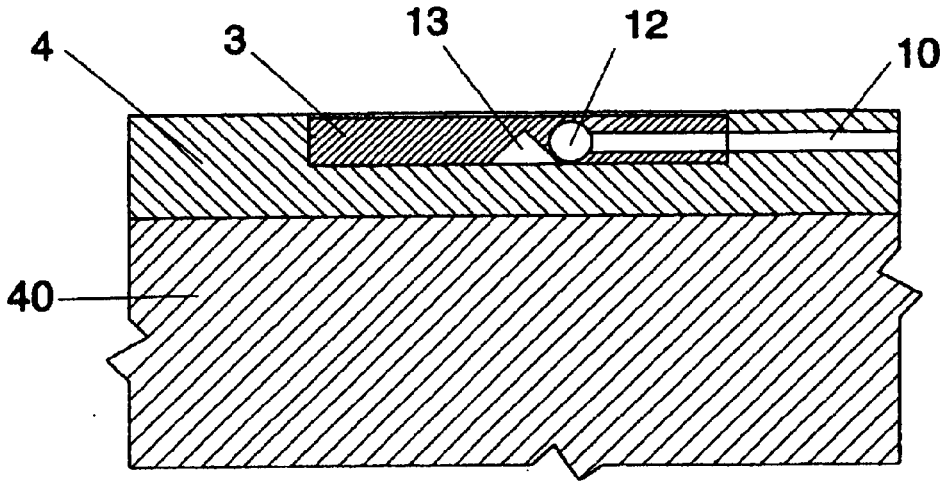
FIG. 4 is an expanded cross-sectional view of one embodiment of the optical waveguide outer lens at the cross-section of FIG. 2.

In FIG. 3, light coupled into an optical fiber (30) contained within the stationary vacuum tube (1) and terminating in stationary passage (15) is collimated by a lens (7). In this embodiment, the light is transmitted into the rotating transparent center fixture portion of the pad's wave-guide (10), folded by a mirror (9), and focused by another lens (8) into the light coupling transparent center fixture end of the optical fiber (10), which is embedded in a recess in the polishing pad (14), the light travels the length of the optical fiber (10), emerges (FIG. 4) from the outer lens fixture (3)

of the optical fiber ( ), is collimated by lens (12), and reflected upwards, out of the waveguide by mirror (13) to provide light delivery to and receipt of the reflection from a wafer's surface. The outer lens in this embodiment fills the recess in the pad as shown in FIG. 4.

Figure 3B:
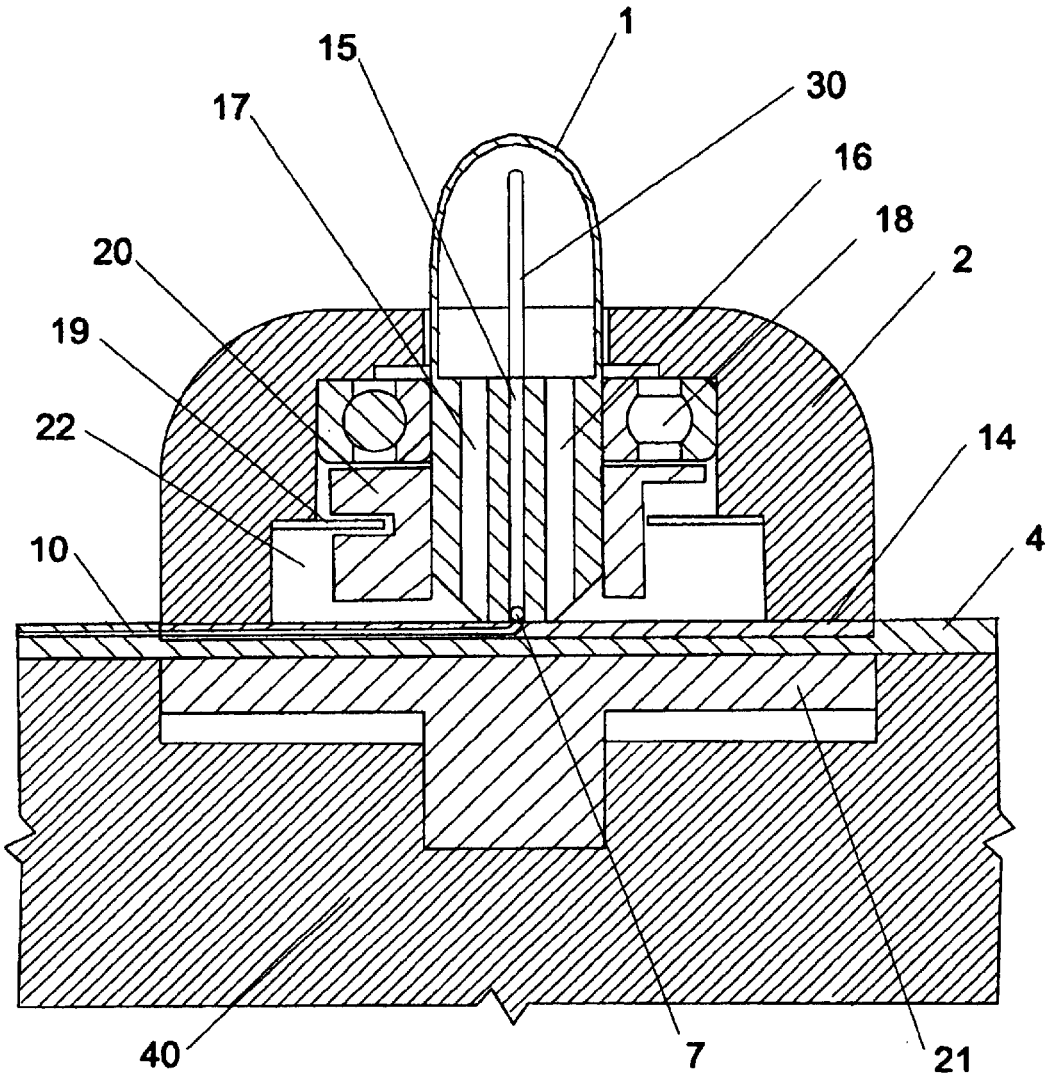
FIG. 3*b* is an expanded cross-sectional view of the preferred embodiment of the hub at the cross-section of FIG. 2.
Figure 4B:
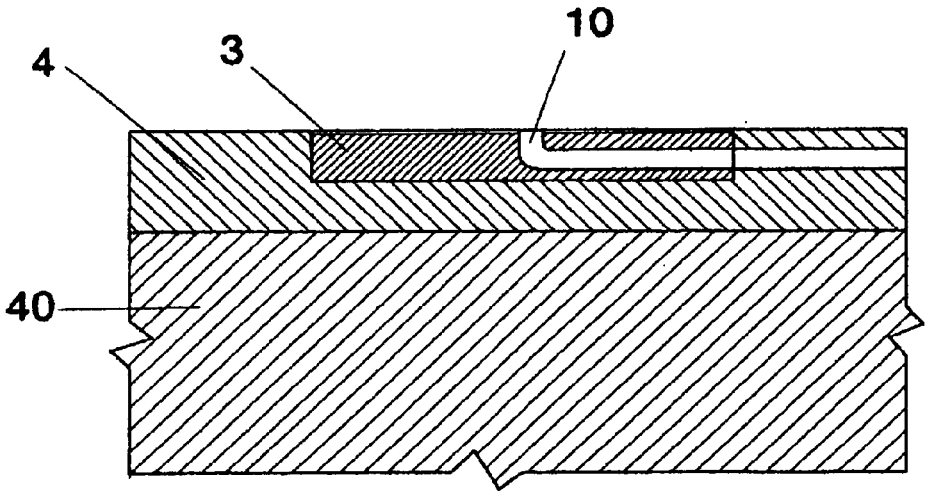
FIG. 4*b* is an expanded cross-sectional view of the preferred embodiment of the optical waveguide outer lens at the cross-section of FIG. 2.

Alternately, the preferred embodiment is shown in FIGS. 3*b* and 4*b*, light coupled into an optical fiber (30) contained within the stationary vacuum tube (1) and terminating in stationary passage (15) is collimated by lens (7). The light is transmitted into the rotating transparent center portion fixture of the pad's wave-guide (10), directly into one end of the optical fiber (10), which is embedded in a recess in the polishing pad (14). The light traverses a 90 degree bend, travels the length of the optical fiber, emerges (FIG. 4*b*) from the outer lens (3) at the opposite end of the optical fiber after traversing a through a second 90 degree bend to provide light delivery to and from a wafer's surface. The outer lens in this preferred embodiment also fills the recess in the pad as shown in FIGS. 4*a* and 4*b*.

If a wafer is present parallel to the polishing pad surface and in close proximity to the waveguide outer lens fixture, the light emerging from the waveguide will reflect from the wafer and re-enter the waveguide outer lens fixture. The reflected light will travel the above mentioned route in reverse, traveling the length of the optical fiber, and emerging from the waveguide transparent center fixture as a focused beam at the stationary lens; where it enters the stationary optical fiber, travels through that fiber, and emerges from the end of the optical fiber contained within the vacuum tube, into which the source light was originally coupled. The reflectance can then be analyzed by conventional methods to determine the geometry and and/or composition of the wafer being processed.

FIGS. 3 and 3*b* also shows a bearing (18) into which the stationary vacuum tube (1) is pressed into the inner bearing race, and vacuum hub (2) spins with the outer bearing race. The vacuum tube contains two other passages shown in FIGS. 3 and 3*b*, in addition to the optical fiber passage (15) mentioned above. Passages (16) & (17) are used to accommodate encoder cabling and to port vacuum into the vacuum cavity (22). The surface of the hub in contact with the pad provides a seal for the vacuum attachment of the hub to the pad. Also shown are the rotating angular encoder disk (19), the stationary encoder electronics (20), and the polishing pad locating plate (21), as well as the polishing table (40).

Figure 5:
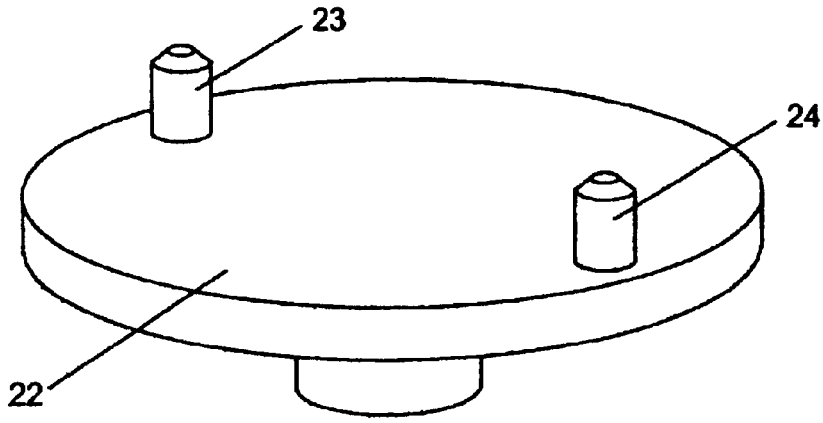
FIG. 5 is an isometric view of an embodiment of the present invention in which the locating dowels are mounted on a locating plate.

FIG. 5 shows an isometric view of the polishing pad locating plate (21) and the two polishing pad locating dowels (23) & (24). Alternately, the locating dowels may be installed directly into the polishing table, if the polishing table cannot accommodate the polishing pad locating plate.

Figure 6:
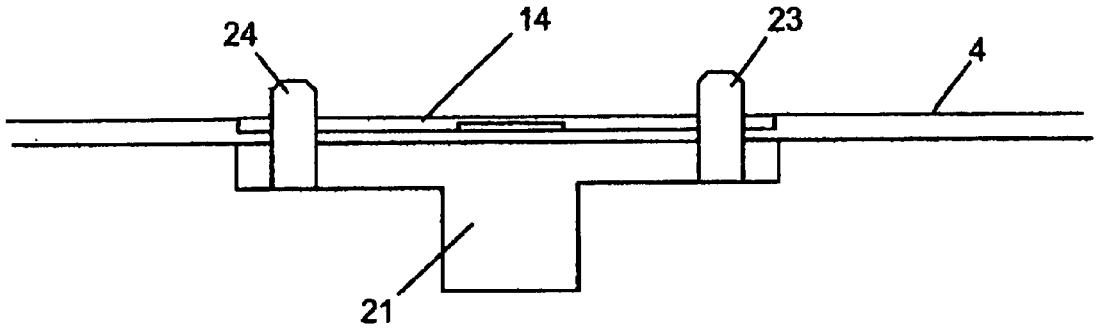
FIG. 6 is a cross-sectional view of an embodiment of the present invention in which the locating dowels are mounted on a locating plate. This cross-section is taken at the location shown in FIG. 1.

FIG. 6 shows a cross-sectional side view of the polishing pad (4) located onto the polishing pad locating plate (21), with the two polishing pad locating dowels (23) & (24) engaging two corresponding holes punched through the polishing pad at the transparent center portion fixture of the optical wave guide (14).

What is claimed is:

1. An apparatus for electronic wafer chemical-mechanical-planarization table process monitoring comprising:

a. a polishing pad and a hub;

b. the polishing pad having a polishing surface and an attachment surface and containing an embedded waveguide with an outer lens fixture end with a means for delivering light and a light coupling transparent center fixture end;

c. the waveguide is arranged within the pad interior such that the transparent center fixture end and outer lens fixture end is embedded within a recess on the pad polishing surface such that the ends are located on the pad polishing surface;

d. the waveguide is arranged within the pad interior such that the transparent center fixture end is at the center of rotation of the polishing pad and the outer lens fixture end is at a location within the wafer track wherein when opposite a wafer contacting the surface of the polishing pad, a light delivery means provides light to and receives surface reflectance from the wafer;

e. the hub contains a moving portion and a stationary portion rotatably connected and arranged such that the moving portion positions the stationary portion wherein light may be transmitted from the hub stationary portion to the waveguide transparent center fixture end and light may be transmitted from the waveguide transparent center fixture end to the hub stationary portion; and f. means for light conductance between the hub stationary portion and stationary portion of the table CMP tool.

2. The apparatus for electronic wafer chemical-mechanical-planarization table process monitoring as in claim 1 further comprising the outer lens fixture and light delivery means is an optical fiber end after traversing a bend.

3. The apparatus for electronic wafer chemical-mechanical-planarization table process monitoring as in claim 1 further comprising the transparent outer lens fixture end light delivery means is an optical fiber end collimated by a lens and reflected by a mirror.

4. The apparatus for electronic wafer chemical-mechanical-planarization table process monitoring as in claim 1 further comprising the hub contains an angular position encoder arranged with a means for conducting electronic signals to and from the hub stationary portion to the stationary portion of the table.

5. The apparatus for electronic wafer chemical-mechanical-planarization table process monitoring as in claim 4 further comprising the angular position encoder electronic signals measure the direction, angle, and speed using electronic devices functionally equivalent to encoders and resolvers.

6. The apparatus for electronic wafer chemical-mechanical-planarization table process monitoring as in claim 5 further comprising the hub is attached to the polishing pad by vacuum.

7. The apparatus for electronic wafer chemical-mechanical-planarization table process monitoring as in claim 6 further comprising the hub is positioned on the polishing pad by a plurality of locating dowels and corresponding locating holes in the polishing pad and hub.

8. The apparatus for electronic wafer chemical-mechanical-planarization table process monitoring as in claim 7 further comprising the means for light conductance between the hub stationary portion and stationary tool portion of the table and means for conducting electronic signals to and from the hub stationary portion to the stationary portion of the table is contained within a vacuum tube connected to the hub stationary portion and configured such that the vacuum tube and signal processing is attached to stationary optical analysis equipment.

9. An optical signal delivery and retrieval system to measure wafer surface reflectivity on a rotating planarization table comprising:

a. means for providing light to the surface of a rotating wafer polishing pad;

b. means for receiving reflected light from the wafer surface in contact with the rotating pad surface;

c. means for conducting the light providing means and light receiving means through the center of rotation of the polishing pad, to a stationary source and stationary signal processor; and d. means for sensing the position of the polishing pad surface light providing means and light receiving means.

10. A method of manufacturing an electronic semiconductor wafer chemical-mechanical-planarization monitoring system comprising:

e. imbedding a waveguide with a sensing end and a light coupling end in a polishing pad;

f. attaching the outer lens fixture end on the polishing pad surface at a location within the pad wafer track;

g. locating the waveguide light coupling fixture end on the polishing pad surface at the center of rotation of the polishing pad;

h. positioning a hub on the polishing pad over the waveguide light coupling end such that a stationary optical fiber within the hub transmits and receives light from the waveguide light coupling end;

i. installing an angular position encoder within the hub such that the pad direction, angular position and speed may be monitored; and j. connecting the hub stationary optical fiber and angular position encoder from the hub to optical and electrical monitoring equipment.

11. The method of manufacturing an electronic semiconductor wafer chemical-mechanical-planarization monitoring system as in claim 10 further comprising applying a vacuum to the hub following positioning to attach the hub to the pad.

12. The method of manufacturing an electronic semiconductor wafer chemical-mechanical-planarization monitoring system as in claim 11 further comprising arranging the connections from the hub stationary optical fiber and angular position encoder through a tube also supplying the vacuum.

13. The method of manufacturing an electronic semiconductor wafer chemical-mechanical-planarization monitoring system as in claim 10 further comprising monitoring the signal from the angular position encoder using electronic devices functionally equivalent to encoders and revolvers.

* * * * *